United States Patent [19]

Barth

[11] 4,386,731

[45] Jun. 7, 1983

[54] DAMPER CONSTRUCTION FOR A GAS FIRED COMBUSTION APPARATUS

[76] Inventor: James T. Barth, 3082 Pine La., Wisconsin Rapids, Wis. 54494

[21] Appl. No.: 320,319

[22] Filed: Nov. 12, 1981

[51] Int. Cl.[3] ..... G05D 23/08

[52] U.S. Cl. ..... 236/1 G; 236/93 R; 236/101 B

[58] Field of Search ..... 236/1 G, 93 R, 101 B, 236/101 D; 374/206, 207

[56] References Cited

U.S. PATENT DOCUMENTS

| | | | |
|---|---|---|---|
| 1,578,112 | 3/1926 | Ernst | 236/93 R |
| 1,784,608 | 12/1930 | Meyers | 236/93 R |
| 3,174,687 | 3/1965 | Gilbert | 236/101 B X |
| 4,114,805 | 9/1978 | Humphreys et al. | 236/1 G |
| 4,151,952 | 5/1979 | Edwards | 236/101 D X |
| 4,165,833 | 8/1979 | Nagel | 236/1 G |
| 4,273,283 | 6/1981 | Edwards | 236/101 D X |

*Primary Examiner*—William E. Tapolcai
*Attorney, Agent, or Firm*—Zarley, McKee, Thomte, Voorhees & Sease

[57] ABSTRACT

A thermally controlled damper construction for a gas fired combustion apparatus such as a furnace, water heater or the like, is described. The damper is pivotally mounted within the stack of the combustion apparatus for pivotal movement from a closed position to a full open position. A thermally responsive device is disposed in the stack on the upstream side of the damper for opening and closing the damper in response to predetermined temperatures. The thermally responsive device comprises a shaft mounted in the stack which extends thereacross and which has the damper rotatably mounted thereon. A helical bi-metal element embraces the shaft between the ends thereof and comprises first and second bi-metal members which are secured together in an end-to-end relationship. The first and second bi-metal members are oppositely disposed with respect to each other whereby the first bi-metal member yieldably urges the damper to its open position when it is subjected to a predetermined temperature and whereby the second bi-metal member yieldably urges the damper towards its closed position when subjected to a predetermined temperature. A heat sink structure is provided adjacent the second bi-metal member so that the second bi-metal member will be initially slowly heated and subsequently cooled more slowly.

5 Claims, 5 Drawing Figures

DAMPER CONSTRUCTION FOR A GAS FIRED COMBUSTION APPARATUS

BACKGROUND OF THE INVENTION

Various types of automatic damper control devices have been marketed for use with furnaces, hot water heaters and other heating devices for the purpose of minimizing the loss of heat and conserving fuel. Damper control devices are normally designed to close the flue or stack during periods when the furance is not operating to prevent the stack heat from being dissipated to the atmosphere and to prevent the loss of conditioned air from the room by convection through the stack. When the furnace is operated, the automatic damper control device will move the damper to an open position to permit flow of the waste gases of combustion to the atmosphere.

In one common form of automatic damper control, the damper is moved between the closed and open positions by an electric motor which is operably connected to the room thermostat in the building. When the thermostat calls for heat, the motor is operated to move the damper to the open position. Motor controlled dampers require relatively expensive components, and if the electrical power is shut down, the damper control will be inoperative.

Another type of automatic damper control is a pressure responsive type which is used with oil fired furnaces. As shown in the patent to Scott, U.S. Pat. No. 1,743,731, the pressure of the draft in the flue will open the damper when the motor blower of the furnace is operated. When the operation of the blower is discontinued, the damper will move by gravity to the closed position.

Automatic damper controls have also been constructed utilizing a temperature responsive mechanism, such as a bimetallic element, to control the operation of the damper as disclosed in U.S. Pat. No. 3,366,333. In applicant's U.S. Pat. No. 4,225,080, an apparatus was disclosed which represented a significant improvement over the prior art devices. Applicant's U.S. Pat. No. 4,289,271 also represented a significant improvement over the apparatus of applicant's earlier patent. In U.S. Pat. No. 4,289,271, a linkage was provided to relieve stress on the bi-metal element after the damper had been pivotally moved to its full open position.

Although the devices disclosed in applicant's earlier patents have been found to be quite satisfactory, the instant invention is designed to more quickly open and close the damper to further conserve heat. A further advantage of the instant invention is a more economical means of relieving stress on the bi-metal element.

Therefore, it is a principal object of the invention to provide an improved thermally controlled damper for an exhaust flue of a combustion apparatus such as a furnace, water heater or the like.

A further object of the invention is to provide a thermally controlled damper including means for relieving the stress on the bi-metal element.

A further object of the invention is to provide a thermally controlled damper for a gas fired combustion apparatus wherein the damper is more quickly moved to its open and closed positions.

A still further object of the invention is to provide a thermally controlled damper for a gas fired combustion apparatus which is economical of manufacture and durable in use.

These and other objects will be apparent to those skilled in the art.

SUMMARY OF THE INVENTION

The invention relates to an improved thermally controlled damper for an exhaust flue of a combustion apparatus, such as a furnace, water heater or the like. In accordance with the invention, a damper, having a generally elliptical shape, is mounted for pivoting movement within the stack or flue from a closed position, where the damper is located at an acute angle with respect to the axis of the stack, to a full open position where the damper is generally parallel to the stack axis.

Operation of the damper is controlled by a bi-metallic element which is located upstream of the damper and operably connected to the damper shaft. When the furnace is operated, the increase in stack temperature will actuate the bi-metal element to pivot the damper from the closed to open position. The bi-metal element comprises first and second bi-metal members which are wound in a helical fashion and which are reversed with respect to one another so that the second bi-metal member is oppositely disposed to the first bi-metal member. A heat sink means is provided adjacent the second bi-metal member so that the second bi-metal member will be slowly heated during the initial operation of the gas fired combustion apparatus. When the gas fired combustion apparatus is initially operated, the increase in stack temperature will actuate the first bi-metal member to pivot the damper from the closed to open position. The secod bi-metal member absorbs heat slowly and rotates slowly in the opposite direction of the first bi-metal member to effectively reduce stress on the first bi-metal member under high heat conditions. When the gas fired combustion apparatus is shut down, the damper will begin to close rapidly through the second bi-metal member. When the damper is closed and the second bi-metal member cools, the combination of bi-metals self-adjust to idle temperature and are ready for rapid opening when the gas fired combustion apparatus is operated on its next cycle.

DESCRIPTION OF THE PREFERRED EMBODIMENT

Figure 1:
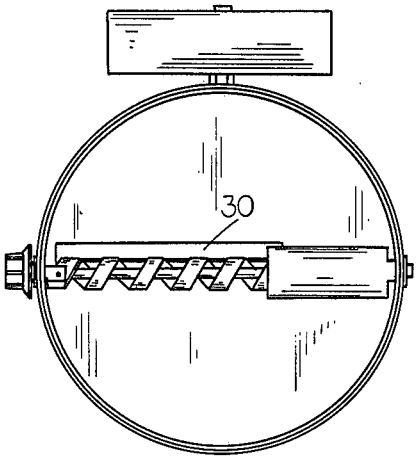
FIG. 1 is a bottom view of the damper construction of this invention.
Figure 2:
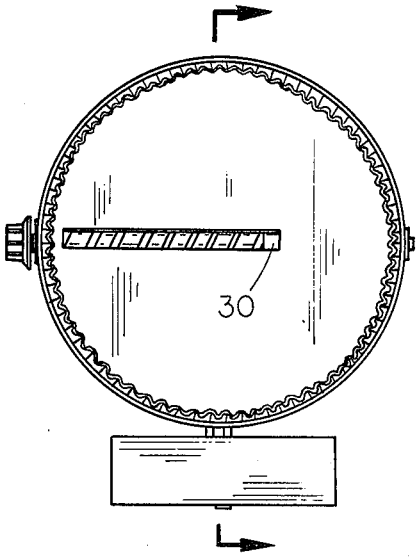
FIG. 2 is a top view of the damper of FIG. 1.
Figure 3:
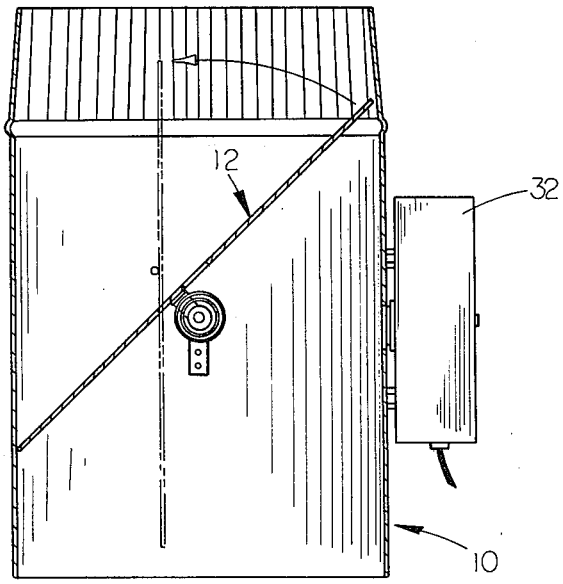
FIG. 3 is a sectional view of the damper as seen on lines 3—3 of FIG. 2.
Figure 4:
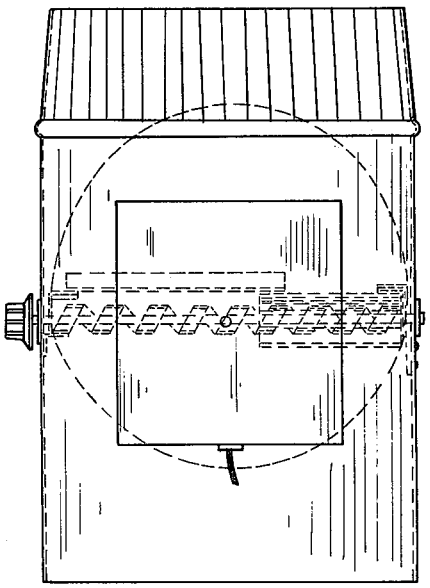
FIG. 4 is a sectional view as seen on lines 4—4 of FIG. 3.
Figure 5:
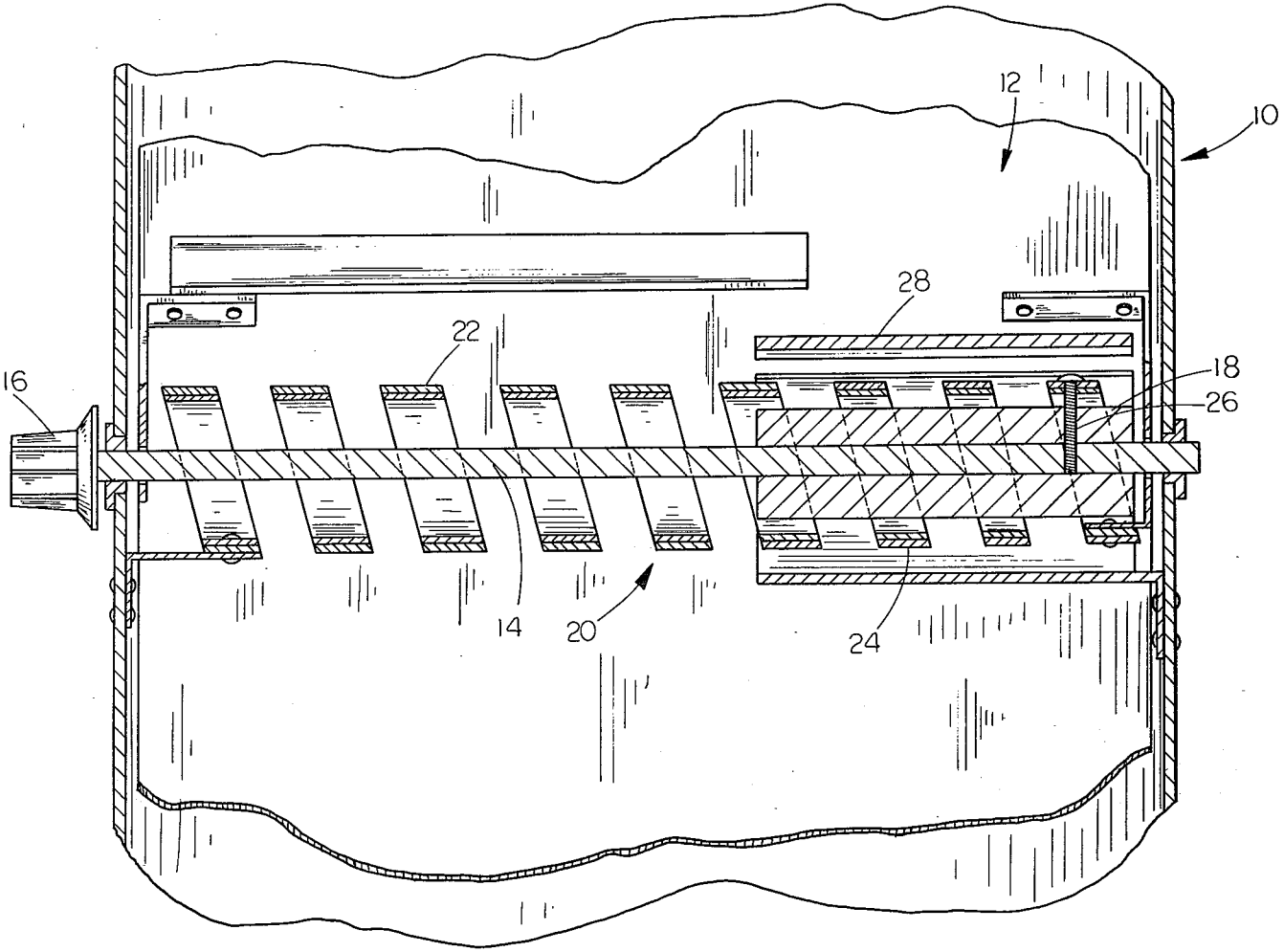
FIG. 5 is a partial sectional view of the damper.

The numeral 10 refers generally to a stack or flue which is connected to a gas fired combustion apparatus such as a furnace, hot water heater, space heater or the like. Damper 12 is pivotally mounted within the stack 10 by means of being operatively secured to a shaft 14 which is rotatably mounted in the stack and which extends transversely with respect to the axis of the stack. As seen in the drawings, damper 12 is generally elliptical in configuration and when in the closed position as illustrated in FIG. 3, the damper is positioned at an acute angle with respect to the axis of the stack 10. As seen in the drawings, a knob 16 is secured to one end of the shaft 14 to permit the selective rotation of the shaft and the damper.

The numeral 18 refers to a heat sink element comprised of metal or the like which is mounted on one end of the shaft 14 for rotation therewith. The numeral 20 refers to a thermally responsive bi-metal means which embraces the shaft 14 and which extends across the stack 10 as illustrated. Bi-metal means 20 is comprised of bi-metal elements 22 and 24. The bi-metal elements 22 and 24 are conventional in construction except that element 24 is oppositely disposed to element 22. Element 22 comprises approximately two-thirds of the total length of the bi-metal means 20 with element 24 comprising approximately one-third of the total length of the bi-metal means 20. As stated, element 24 is oppositely disposed with respect to element 22. In other words, element 24 is turned "inside out" with respect to element 22. Thus, when element 22 is subjected to heat, the element 22 will tend to expand while element 24 will tend to contract when subjected to heat. The ends of elements 22 and 24 are secured together by any convenient means.

One end of element 24 is secured to the heat sink element 18 by means of screw 26 which extends through the element 24, heat sink element 18 and into the shaft 14. One end of the element 22 is operatively secured to the stack 10 by any convenient means. A second heat sink element 28 in the form of a shroud or the like is operatively secured to stack 10 and embraces bi-metal element 24. As seen in the drawings, damper 12 is provided with an elongated rectangular opening 30 formed therein. As also seen in the drawings, a temperature responsive safety mechanism 32 is also provided which does not form a portion of the invention.

FIG. 3 illustrates the damper 12 in its closed position. When the furnace is not operating, the gases of combustion from the pilot light, if so equipped, will pass upwardly through the stack and through the opening 30. Assuming that the furance is inactivated, the damper 12 remains in the closed position until the bi-metal element 22 is subjected to sufficient temperature so as to begin the opening of the damper 12. In practice, the bi-metal element 22 is constructed so as to begin opening the damper 12 when the stack temperature is approximately 130° F., and the damper will be fully opened at a stack temperature of 225° F. As stated, when the furnace or gas fired combustion apparatus is operated, the increase in stack temprature will actuate bi-metal element 22 to pivot the damper from the closed to open position. Bi-metal element 24 absorbs heat slowly due to the heat sink elements 18 and 28 and rotates slowly in the opposite direction of bi-metal element 22. The opposite rotation of element 24 with respect to that of element 22 effectively reduces stress on element 22 under high heat conditions.

When the furnace is shut down, the damper will begin closing rapidly inasmuch as element 24 yieldably urges the damper to its closed position. When the damper is closed and element 24 cools, the combination of bi-metals self-adjust to the idle temperature and are ready for rapid opening when the furnace is operated on its next cycle.

The advantages of providing a thermally responsive member comprised of bi-metal elements operating in opposite directions is that pre-loading of the damper is substantially reduced to insure that the damper will be rapidly opened. The arrangement of the elements 22 and 24 also insure that the damper will be rapidly closed. Further the relationship of the elements 22 and 24 reduces stress reduction on the element 22.

Thus it can be seen that the apparatus of the invention accomplishes at least all of its stated objectives.

I claim:

1. A thermally controlled damper for a gas fired combustion apparatus, comprising, a stack connected to the combustion apparatus and adapted to conduct waste gases of combustion, a damper pivotally mounted within the stack and being movable from a normally closed position to an open position, a thermally responsive means disposed in the stack on the upstream side of the damper for opening and closing said damper in response to predetermined operation of the combustion apparatus, said thermally responsive means comprising an elongated shaft rotatably mounted in said stack and extending thereacross, said shaft having first and second ends, said damper being operatively secured to said shaft, a helical bi-metal means embracing said shaft between the ends thereof and comprising first and second bi-metal elements secured together in an end-to-end relationship, each of said bi-metal elements having first and second ends, said first end of said first bi-metal element being operatively secured to said stack, a first heat sink means mounted on and secured to said shaft adjacent its said second end, said second bi-metal element embracing said first heat sink means and having its said second end operatively secured to said shaft, and a second heat sink means embracing said second bi-metal element and spaced therefrom, said first and second bi-metal elements being oppositely disposed whereby said first bi-metal element urges said damper to its open position when said first bi-metal element is subjected to a predetermined temperature and whereby said second bi-metal element yieldably urges said damper towards its closed position when subjected to a predetermined temperature.

2. The damper of claim 1 wherein said first heat sink means comprises a first cylindrical metal member having said shaft extending therethrough.

3. The damper of claim 2 wherein said second heat sink means comprises a hollow cylindrical member which extends around said second bi-metal element.

4. The damper of claim 1 wherein the length of said second bi-metal element is approximately one-half of the length of said first bi-metal element.

5. The damper of claim 1 wherein said damper has an opening formed therein which is positioned upstream of said first bi-metal element.

* * * * *